US007597428B2

(12) United States Patent
Tanuma

(10) Patent No.: US 7,597,428 B2
(45) Date of Patent: Oct. 6, 2009

(54) INK JET HEAD

(75) Inventor: Chiaki Tanuma, Tokyo-To (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 331 days.

(21) Appl. No.: 11/752,554

(22) Filed: May 23, 2007

(65) Prior Publication Data

US 2008/0036823 A1 Feb. 14, 2008

(30) Foreign Application Priority Data

May 24, 2006 (JP) ..... 2006-143999

(51) Int. Cl.
*B41J 2/045* (2006.01)

(52) U.S. Cl. ..... 347/68

(58) Field of Classification Search ..... 347/68, 347/69–72, 65, 84

See application file for complete search history.

(56) References Cited

U.S. PATENT DOCUMENTS

| | | | | |
|---|---|---|---|---|
| 6,959,471 | B2 | 11/2005 | Temple et al. | |
| 7,527,361 | B2 * | 5/2009 | Sugahara | 347/68 |
| 2006/0181580 | A1 * | 8/2006 | Lee et al. | 347/68 |

FOREIGN PATENT DOCUMENTS

| | | |
|---|---|---|
| JP | 11-207972 | 8/1999 |
| JP | 2001-162795 | 6/2001 |
| JP | 2002-529289 | 9/2002 |
| WO | WO00/29217 | 5/2000 |

OTHER PUBLICATIONS

English Language Translation of Patent Abstract of Japanese Patent Application No. 10-015309 filed Jan. 28, 1998, published on Aug. 3, 1999, under Japanese Publication No. 11-207972.

English Language Translation of Patent Abstract of Japanese Patent Application No. 11-352975 filed Dec. 13, 1999, published on Jun. 19 2001, under Japanese Publication No. 2001-162795.

* cited by examiner

*Primary Examiner*—K. Feggins
(74) *Attorney, Agent, or Firm*—DLA Piper LLP (US)

(57) ABSTRACT

Disclosed is an ink jet head which can eject an ink droplet while preventing failure of ink ejection, resulting in printing an image having good print quality. The ink jet head comprises a plurality of pressure chambers, a nozzle fluidly communicating with respective pressure chamber, first common ink chamber provided on one edge of the pressure chamber, second common ink chamber provided on the other edge of the pressure chamber, and an ink channel fluidly communicating the first common ink chamber with the second. An ultrasonic transducer arranged in a part of the ink channel causes the ink in ink channel to circulate through a passage way formed of the ink channel, the first and second common, ink chambers and pressure chamber.

17 Claims, 9 Drawing Sheets

FIG. 9
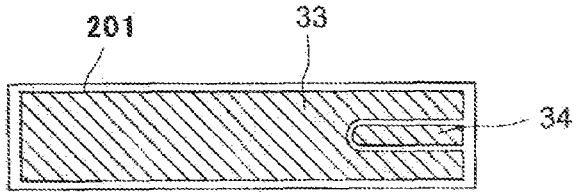
FIG. 10
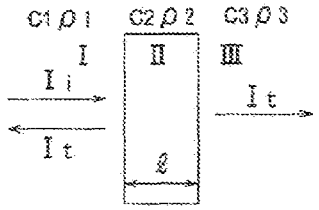
$$\tau I = I t / I i$$
$$= \frac{4}{\left(\sqrt{Z_3/Z_1} + \sqrt{Z_1/Z_3}\right)^2 \cos^2(2\pi l/\lambda_2) + \left(Z_2/\sqrt{Z_1 Z_3} + \sqrt{Z_1 Z_3/Z_2}\right)^2 \sin^2(2\pi l/\lambda_2)}$$
Formula (2)
FIG. 11
FIG. 12
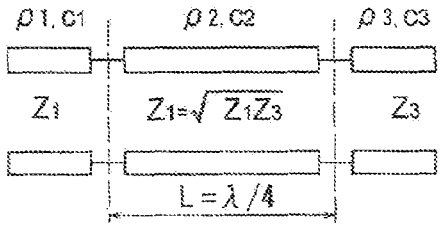

$$dn(f) = \sqrt{(F+n\lambda+\lambda/4)^2 - F^2}$$

n= 0, 1, 2, 3, ···

Formula (3)

$$dn(i) = \sqrt{(F+(2n-1)^2/2+\lambda/4)^2 - F^2}$$

n= 1, 2, 3, ···

Formula (4)

λ: Wavelength of ultrasound

F: Focal length

Table 1: Distane from D-D line to Fresnel band (mm)

| N | 0 | 1 | 2 | 3 |
|---|---|---|---|---|
| dn(f) | 2.5 | 5.6 | 7.6 | 9.2 |
| dn(i) | -- | 4.4 | 6.7 | 8.5 |

FIG. 21

INK JET HEAD

BACKGROUND OF THE INVENTION (1) Field of the Invention

The present invention relates, in general, to an ink jet head, and in particular, to an ink jet head including an ink circulating passage way therein.

(2) Description of the Related Art

In recent years, printers on which an ink jet head is mounted to eject an ink droplet to record an image on a medium are widely popularized in various fields including an industry, a home appliance, and so on. Since the ink jet head readily realizes images in grey scale and in color and has its low running cost the prospect for the future thereof is remarkable.

In the field of an ink jet printer, a Drop-On-Demand (D-O-D) ink jet head is currently a major one.

Japanese Laid-open patent application (KOKAI) PH11-207972 discloses a D-O-D ink jet head comprising a pressure chamber connected to a nozzle in a fluid communication to eject an ink droplet from the nozzle. The pressure chamber is formed of a nozzle plate having the nozzle, a top plate, and a side wall and bottom surface shaped on a piezoelectric material. The side wall is plated with nickel to form an electrode to apply an ink ejection pulse thereto and is deformed to generate pressure to eject the ink droplet when the pulse is applied. The sidewall functions as an actuator for ejecting ink. When air intake from the nozzle accidentally occurs in the operation of the ink jet head and thus a bubble is formed, the bubble dumps the pressure for ejecting ink in the pressure chamber even if the ink ejection pulse is applied to the electrode to deform the actuator. Therefore the ink jet head poses failure of ink ejection upon the air intake. Besides, in case that a waste or a foreign matter remains in a process of manufacturing the ink jet head, or ink includes a foreign matter, the nozzle occasionally clogs with the waste or the foreign matter, posing ejection failure. Furthermore, repetition of applying the ink ejection pulse causes the actuator to generate beat slightly, resulting in lowering viscosity of ink in the pressure chamber. Since characteristic of the ink ejection is changed by the variation of the viscosity, the ink jet head still poses the other problem that quality of printed characters and images is made inconsistent.

International Laid-open patent application (HYO) 2002-520289 also discloses a D-O-D ink jet head. In the publication, described in detail is a manufacturing method of the ink jet head in which a plurality of ink channels are formed on two rows respectively, each being made of a laminated, piezoelectric material.

Japanese Laid-open patent application (KOKAI) P2001-162795 discloses an ink jet head provided with a circulation system for circulating ink in an ink channel in order to prevent a nozzle from clogging with foreign matter, ink ejection characteristic from deteriorating due to air intake, and viscosity of ink from decreasing due to heat generated by repetition of deformation of a piezoelectric material.

To form the circulation system, a dedicated pump is employed in an outside of the ink jet head. Therefore, a controller for controlling the pump and a dedicated space in which the pump is set are needed in an ink jet printer. Besides the circulation system comprises a plurality of elements including a main ink tank, the dedicated pump, a filter, a relay tank, an ink tube fluidly communicating one of the elements with the other, and a connector joining the tube with one of the elements. Thus, a complicated management of the elements and a periodic maintenance are required to keep the system work well. Furthermore, since the plural tubes are needed to fluidly communicate between respective elements in the system, a lot of unavailable ink remains in the tubes as a waste ink.

SUMMARY OF THE INVENTION

An object of the present invention is to provide an ink jet head which can eject an ink droplet while preventing failure of an ink ejection, and print an image having a good print quality.

To accomplish the above-described object, an ink jet head for ejecting ink to record an image on a recording medium, comprising:

- a pressure chamber partitioned by a sidewall shared with adjacent pressure chambers and formed of a piezoelectric material with an electrode on a surface thereof, the pressure chamber having both ends through which ink flows in the pressure chamber;
- a nozzle configured to eject ink from the pressure chamber therethrough;
- a first common ink chamber provided at one of the ends of the pressure chamber to supply ink to the pressure chamber;
- a second common ink chamber provided at the other end of the pressure chamber to take ink from the pressure chamber;
- an ink channel configured to flow ink from the first common ink chamber to the second common ink chamber; and
- an ultrasonic transducer for generating an ultrasound to forcibly move ink by a pressure of the ultrasound, the transducer being arranged in the ink channel,
- wherein ink is forcibly circulated by the ultrasonic pressure through the first common ink chamber, the pressure chamber, the second common ink chamber, and the ink channel.

BRIEF DESCRIPTION OF THE DRAWINGS

These and other objects and advantages of this invention will become apparent and more readily appreciated from the following detailed description of the presently preferred exemplary embodiments of the invention taken in conjunction with the accompanying drawings wherein:

FIG. 8 is a block diagram for driving a piezoelectric vibrator;

FIG. 9 is a modified piezoelectric vibrator used in the other driving method;

FIG. 10 is a view illustrating different mediums having a relationship between an acoustic velocity through a medium and a density of the medium;

FIG. 11 indicates a formula to design an specific acoustic impedance;

FIG. 12 is a view illustrating different mediums each having an inherent specific acoustic impedance;

FIG. 21 indicates two formulas to design, a Fresnel lens shown in FIG. 20 and a table listing dimensions calculated by the formulas;

DETAILED DESCRIPTION OF THE INVENTION

Figure 1:
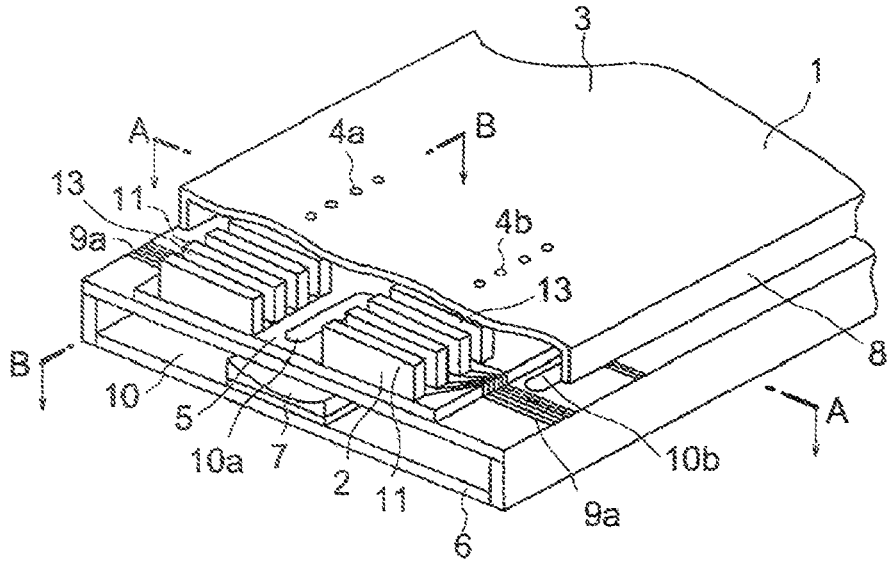
FIG. 1 is a perspective view showing an ink jet head, a part of which shows a cross-sectional view, in the present invention.

The present invention will now be described in more detail with reference to the accompanying drawings. However, the same numerals are applied to the similar elements in the drawings, and therefore, the detailed descriptions thereof are not repeated.

Figure 2:
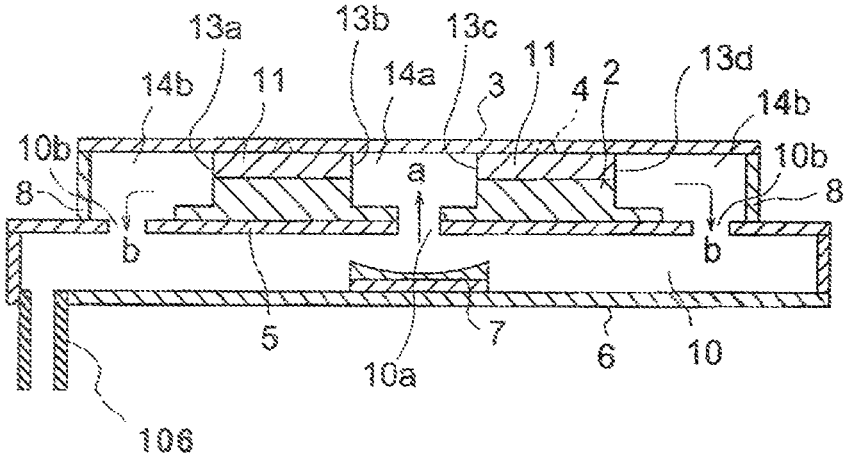
FIG. 2 is a cross-sectional view taken along with A-A line shown in FIG. 1.
Figure 3:
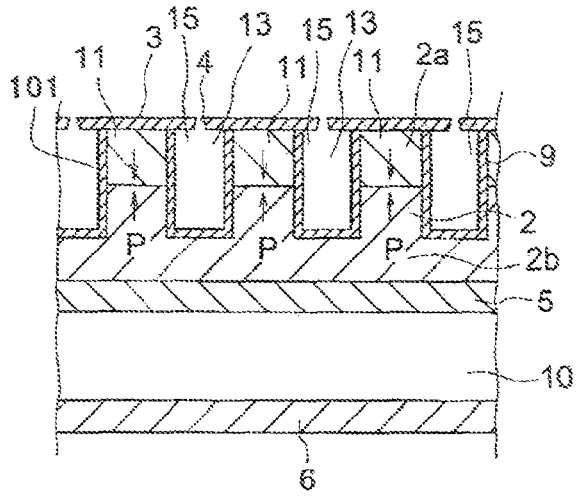
FIG. 3 is a cross-sectional view taken along with B-B line shown in FIG. 1.

An ink jet head employing a system in which ink being ejected from a nozzle is circulated will now be described with reference to FIGS. 1 through 3. FIG. 1 is a perspective view showing an ink jet head 1, a part of which is removed to show an inside feature. FIG. 2 is one cross-sectional view taken along with A-A line in FIG. 1 and FIG. 3 is a part of the other cross-sectional view taken along with B-B line in FIG. 1. Ink jet head 1 comprises a substrate 5, two groups of piezoelectric actuators 101, a nozzle plate 3 including a plurality of nozzles 4*a* and 4*b*, a first common ink chamber 14*a*, a second common ink chamber 14*b*, an ink supply inlet 106, and a housing 6 in which an ultrasonic transducer 7 is placed to circulate ink in ink jet head 1.

Substrate 5 having a desired thickness is formed of a piezoelectric material and is provided with a first opening 10*a* and a second opening 10*b* through which ink passes for circulation. As substrate 5 other materials may be available, e.g., quartz, aluminum nitride, and alumina.

On a surface of substrate 5 the two groups of piezoelectric actuators 101 are glued to form a plurality of ink pressure chambers 15, each of which pressurizes ink to eject an ink droplet from nozzle 4. Piezoelectric actuator 101 is diced from a block 2 of piezoelectric material to shape a sidewall 11 and is formed by providing the sidewall with a drive electrode 9.

Piezoelectric block 2 is made of a lead zirconium titanate (PZT system). Alternatively, piezoelectric material of block 2 includes a lead magnesium niobate (PMN system), and a lead nickel niobate (PNN system), as a base ingredient. Piezoelectric block 2 is formed of two polarized piezoelectric plates 2*a* and 2*b* laminated with a glue such that the polarized directions thereof are opposite to each other, as indicated by an arrow P. After gluing piezoelectric block 2 onto substrate 5, piezoelectric block 2 is processed to shape a plurality of grooves 13 aligned in parallel such that a sidewall 11 is shared with adjacent grooves 13. In this embodiment, 300 grooves are arranged in parallel and grouped in a line. Sidewall 11 measures 2 mm in length, 80 μm in width, and 300 μm in height and has two end surfaces (13*a*, 13*b*, 13*c*, and 13*d*) in a length direction thereof. Groove 13 measures 2 mm in length, 89 μm in width, and 300 μm in depth. Therefore, a distance between centerlines of adjacent grooves 13 is 169 μm in a direction orthogonal to the length direction thereof.

On an inside surface (sidewall 11) defining groove 13, a drive electrode 9 is formed as shown in FIG. 3. Sidewall 11 with drive electrode 9 operates as actuator 101 when applying drive voltage thereon. As a method of forming drive electrode 9, electroless metal plating may be used to form nickel on the inside surface. As the other method, vacuum evaporation or sputtering may also be used to form a metal including aluminum, nickel, and gold on the inside surface. Drive electrode 9 is extendedly connected through a circuit pattern to a terminal 9*a* provided on an edge of substrate 5. An outside drive circuit not shown but well known in the art is connected with terminal 9*a* to apply the drive voltage to actuator 101. Applying ink ejection pulse onto drive electrode 9 causes actuator 11 to deform with shearing force, so called shear mode deformation, to change a volume of pressure chamber 15, resulting in ejecting ink from nozzle 4.

On a top of sidewall 11, nozzle plate 3 made of a polyimide having 30 μm in thickness is affixed by glue. Nozzle 4 having 30 μm in diameter is drilled on nozzle plate 3 to eject an ink droplet in a direction normal to a top surface of nozzle plate 3. Nozzle 4 is positioned at a center in the length direction of groove 13.

A room surrounded by nozzle plate 3, adjacent sidewalls 11 and a bottom surface of groove 13 defines a pressure chamber 15. A distance between adjacent pressure chambers is also 169 μm in a direction orthogonal to the length direction thereof. In other words, ink is ejected from nozzle 4 in a direction orthogonal to the ink flowing direction in the pressure chamber.

Dimension of nozzle 4, sidewall 11, groove 13 and so on, and the number of grooves 13 are not restricted to this embodiment. It may be designed according to a requirement of an ink jet head performance, e.g., resolution of an image, a volume of an ink droplet to be ejected, a print speed, and so on.

In addition, in place of the abovementioned structure including piezoelectric block 2 glued on one surface of substrate 5, the other piezoelectric block may be available in which a substrate is incorporated into a piezoelectric block.

In FIG. 1, pressure chambers 15 are arranged in two separate groups each having the same number of chambers 15. Pressure chamber 15 in one of the groups is shifted by a half of the distance between adjacent pressure chambers with respect to pressure chamber 15 in the other group. According to the arrangement of pressure chambers 15, two nozzle lines 4*a* and 4*b* are formed to include nozzles 4 whose number is the same as pressure chambers 15 in each nozzle line. Therefore, when an ink jet printer employs ink jet head 1 having the above-described construction, it can print an image having double printing density on a recording medium, comparing to ink jet head including a single pressure chamber group.

Incidentally, recording medium includes a material, e.g., a paper, a metal plate, a printed circuit board, and so on, on which a character, an image or a pattern can be printed in ink. Ink includes a liquid in which a dye or a pigment is contained to make an image or in which a conductive powder is contained to form an electric circuit pattern, on a recording medium.

As shown in FIG. 2, a first common ink chamber 14*a* is formed at a space between opposed end surfaces 13*b* and 13*c* of sidewall 11 (between two pressure chamber groups) to supply ink into respective pressure chambers 15 in each group. One of second common ink chambers 14*b* is formed at a space outside the end surface 13*a* (outside one of the pressure chamber groups) and the other second common ink chamber 14*b* is also formed at a space outside the other end surface 13*d* (outside the other pressure chamber group) to take ink from respective pressure chambers 15 in each group. First and second common ink chambers 14*a* and 14*b* are enclosed by nozzle plate 3, a side plate 8, and substrate 5 to form an ink passage extending from the first common ink chamber 14*a* to the second common ink chambers 14*b* through pressure chambers 15 of respective group.

Figure 4:
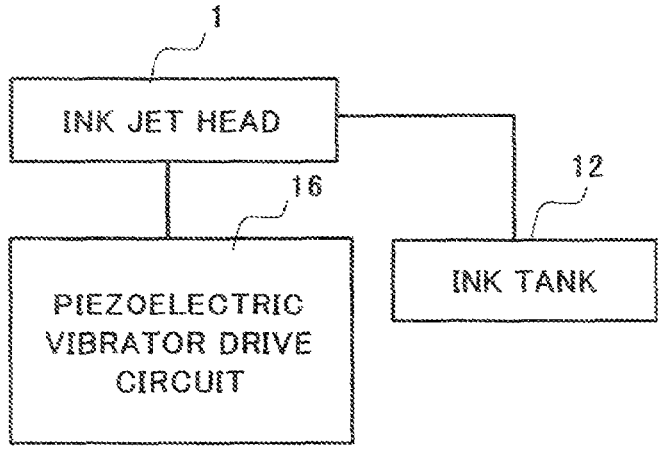
FIG. 4 is a block diagram illustrating a general structure in the present invention.

An ink channel 10 is formed of an opposite surface of substrate 5 and a housing 6 encircling the opposite surface and no pressure chamber 15 is provided in the channel 10. In other words, ink channel 10 resides in the opposite side of nozzle 4 with respect to pressure chamber 15. A first opening 10*a* is formed on substrate 5 so that ink channel 10 fluidly communicates with first common ink chamber 14*a* therethrough. Second openings 10*b* are also formed on substrate 5 so that ink channel 10 fluidly communicates with second common ink chambers 14*b* therethrough, correspondingly. First opening 10*a* is formed in elliptical shape of 5 mm in length and 1 mm in width. Second openings 10*b* are respectively formed in the same shape and dimension as first opening 10*a*. As shown in FIG. 2, an ink supply inlet 106 is provided to supply ink into ink jet head 1. Ink is supplied from an outside ink tank 12 shown in FIG. 4 to ink channel 10 through ink supply inlet 106. First opening 10*a*, first common ink chamber 14*a*, pressure chambers 15, second common ink chambers 14*b*, second openings 10*b*, and ink channel 10 forms an ink circulating passage.

For circulating ink, an ultrasonic transducer 7 is provided on an inside surface of housing 6 at a position corresponding to first opening 10*a*. Ultrasonic transducer 7 radiates an ultrasound toward first opening 10*a*. The ultrasonic pressure produced by the ultrasound forces ink in ink channel 10 to flow through first opening 10*a* into first common ink chamber 14*a*, as indicated by an arrow "a" in FIG. 2. Subsequently, ink runs through pressure chambers 15, second common ink chambers 14*b*, and second openings 10*b* respectively in order, and returns to ink channel 10. This structure can realize that ink filled in pressure chambers 15 is forcibly moved or circulated.

Figure 5:
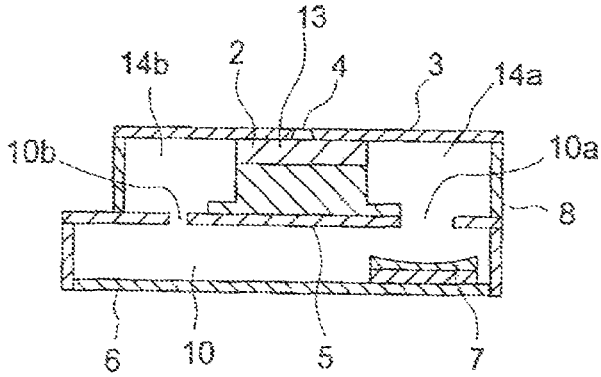
FIG. 5 is a cross-sectional view showing the other ink jet head in the present invention.

Incidentally, instead of the two groups of pressure chambers 15, a single group of pressure chambers 15 can be available as shown in FIG. 5. As can be understood from this FIGURE, a structure of the ink jet head shown in FIG. 5 only eliminates one of the groups of pressure chambers 15, one of the second common ink chambers 14*b* and corresponding second opening 10*b* from the ink jet head shown in FIG. 2 and thus explanation thereof is not repeated. The ultrasonic pressure produced by the ultrasound forces ink in first common ink chamber 14*a* to flow through pressure chamber 15 into second common ink chamber 14*b*, Subsequently, ink moves through second opening 10*b* to return to ink channel 10, resulting in circulation of the ink.

Figure 6:
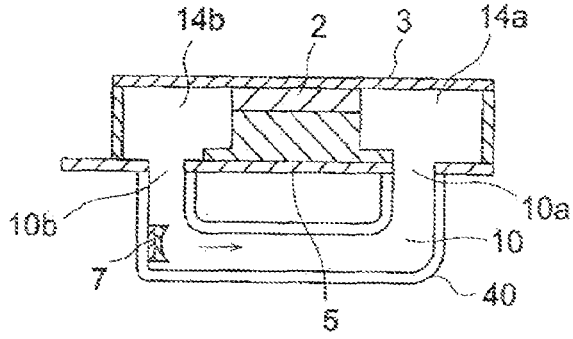

Alternatively, a U-shaped pipe 40 may also be available on a rear surface of substrate 5 to form ink channel 10, as shown in FIG. 6. Ultrasonic transducer 7 is affixed on an inside surface of the stub of U-shaped pipe 40 to forcibly move ink filled therein in an ultrasonic propagating direction along pipe 40. Hence, ink can circulate through pipe 40, first and second common ink chambers 14*a* and 14*b*, and pressure chamber 15.

Although the above-mentioned structure exemplifies an ink jet head having an ultrasonic transducer 7 provided at ink channel 10, a position of ultrasonic transducer 7 is not restricted to ink channel 10. For example, ultrasonic transducer 7 may be provided at first or second common ink chamber 14*a* or 14*b*.

The ink circulation system in which ink in pressure chamber 15 is forcibly carried toward the second common ink chamber(s) realizes removal of air bubbles and foreign matters even if air intake from nozzle 4 may occur in operation of ink jet head 1, or foreign matters carried with ink may accidentally remains in pressure chamber 15. Removal of air bubbles or foreign matters can prevent failure of an ink ejection.

In an operation of an ink ejection, actuator 101 is reiteratedly deformed so that actuator 101 generates heat slightly, resulting in raising temperature in ink. Since the ink circulation system makes the heated ink in pressure chamber 15 be exchanged with unhealed ink, alleviating variation of viscosity in the ink due to increased temperature, stable ink ejection can be realized. As a result, printed quality in character and image can be made stable.

Ultrasonic transducer 7 may be formed to be small and flat, and disposed in an inside of ink channel depending on a shape of the ink passage way. Therefore, ink jet head 1 can be miniaturized because size of ink channel can be reduced. The miniaturized ink channel can also save consumption of ink because an amount of ink filled in ink channel 10 is reduced.

Ultrasonic transducer 7 provided in the passage way will now be described with reference to FIGS. 7 through 21.

First Embodiment

Figure 7:
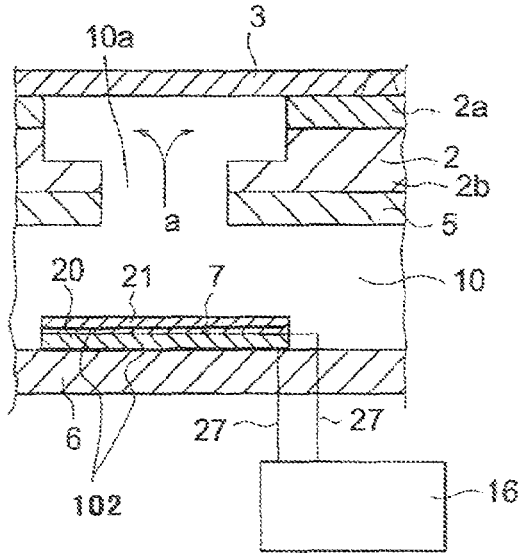
FIG. 7 is a cross-sectional view showing a portion in which ultrasonic transducer is provided in the first embodiment.
Figure 8:
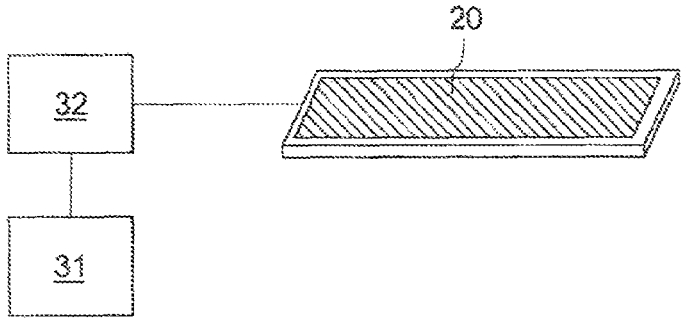
FIG. 8 is a cross-sectional view showing the other ink channel in the present invention.

FIG. 7 shows a cross sectional view of ultrasonic transducer 7 provided in ink channel 10. Ultrasonic transducer 7 is affixed to an inside surface of housing 6 such that it faces to first opening 10*a* through which ink passes from ink channel 10 to first common ink chamber as indicated by arrow "a." Housing 6 is made of a lead zirconium titanate. The material of housing 6 including a metal, resin, glass, ceramic, and so on, may be available.

Ultrasonic transducer 7 includes a piezoelectric vibrator 20 as a source of ultrasound. Piezoelectric vibrator 20 is formed in a flat shape and has an electrode 102 on both surfaces thereof. Piezoelectric vibrator 20 is connected through a lead wire 27 with a piezoelectric vibrator drive circuit 16 provided outside ink jet head 1 to apply a drive signal to electrode 102. Applying the drive signal causes piezoelectric vibrator 20 to radiate an ultrasound from the both surfaces in a direction orthogonal to the surface. Piezoelectric vibrator drive circuit 16 comprises a signal generator 31 and a high-frequency amplifier 32, shown in FIG. 8. Signal generator 31 generates a signal having a frequency as high as a resonant frequency of piezoelectric vibrator 20 and subsequently high-frequency amplifier 32 amplifies the signal to a desired output value.

Then output power of the ultrasound out of piezoelectric vibrator 20 is controlled in accordance with electric power supplied to piezoelectric vibrator 20. The electric power supplied, for example, ranges approximately from 1 to 20 W.

A modified piezoelectric vibrator 201 will be described with reference to FIG. 9. Piezoelectric vibrator 201 is of rectangle and has excitation electrodes 33 provided on both surfaces thereof to generate self-excited, oscillation and a feedback electrode 34 in a part of one excitation electrode 33. Feedback electrode 34 is shaped to be a strip such that the strip is arranged from one edge in length of the rectangle toward a center of that. A signal detected by feedback electrode 34 is returned to piezoelectric vibrator drive circuit 16 to make a feedback control. Because of the feedback control, signal generator 31 shown in FIG. 8 can be omitted. Incidentally, as a variety of electric circuits for self-excited oscillation are known, the electric circuit may be designed in light of requirement of resonant frequency, applied power, and so on.

Ultrasonic transducer 7 is formed of a laminated member comprising a piezoelectric vibrator 20 producing ultrasound and a matching member 21 which is to be exposed to ink in ink channel. The ultrasound produced by piezoelectric vibrator 20 propagates into ink through matching member 21. Matching member 21 functions to reduce propagation loss of the ultrasound produced by piezoelectric vibrator 20. The propagation loss closely relates to a specific acoustic impedance of a material including ink, a matching member, and a piezoelectric vibrator, having an inherent value of the impedance respectively. The larger a difference of the specific acoustic impedances between piezoelectric vibrator 20 and the ink in ink channel goes, the larger the propagation loss becomes.

A method of designing matching member 21 for reducing the propagation loss will be described with reference to FIGS. 10 through 12.

When ultrasound reaches a boundary surface made of a first material having a first specific acoustic impedance and a second material brought, into contact with the first material and having a second specific acoustic impedance different from the first one, a part of the ultrasound passes through the boundary and the other part of that reflects off the boundary. Generally, a product of a density "ρ" of a material and a sound velocity "c" in the material (ρ×c) is called as "specific acoustic impedance." Assume that the ultrasound reaches a boundary surface made of two materials having specific acoustic impedances $Z_1$ and $Z_2$ respectively in a direction normal to the boundary. Then, amplitude reflectance "Re" is calculated by a formula (1) Re=(Z1−Z2)/(Z1+Z2).

Amplitude reflectance and specific acoustic impedances of mediums I, II, and III, corresponding to piezoelectric vibrator 20, matching member 21, and ink in order, will be described. Medium II having a thickness "L" is interposed between mediums I and III. Assume that an incident ultrasound to medium I has an intensity "Ii", an ultrasound having passed through medium II has an intensity "It" in medium III, and sets of the sound velocity and the density c1, ρ1, c2, ρ2, and c3, ρ3 correspond to mediums I, II, and III respectively. A ratio "τI" of It and Ii is calculated by a formula (2) in FIG. 11 in a same fashion of a method calculating incident and transparent ultrasounds at a plain boundary surface. In the formula (2) $\lambda_2$ means a wavelength of the ultrasound passing through medium II. The $\lambda_2$ is calculated by $\lambda_2=c2/f_2$, where $f_2$ indicates a frequency of the ultrasound passing through medium II.

As shown in FIG. 12, if thickness "L" and specific acoustic impedance "$Z_2$" of medium II exactly meet with $L=\lambda_2/4$ and $Z_2=(Z_1\times Z_2)^{1/2}$, the ratio τI results in τI=1. It means that the incident ultrasound to medium II completely passes through medium II without propagation loss, i.e., with no reflection. Ideally, energy of the ultrasound provided by medium I, i.e., piezoelectric vibrator 20, can be propagated into medium III, i.e., the ink in ink channel 10 without propagation loss, resulting in conveying the ink toward first opening 10*a*, if matching member 7, i.e., an middle layer, is interposed therebetween to be in condition with $L=\lambda_2/4$ and $Z_2=(Z_1\times Z_2)^{1/2}$.

As set forth above, a specific acoustic impedance can be determined by designing a material and thickness thereof to satisfy formulas (1) and (2). However, since the specific acoustic impedance is an inherent value with respect to the material, it is not easy to select the material to exactly satisfy the formulas. Actually, in order to reduce the propagation loss brought about between medium I, i.e., piezoelectric vibrator 20, and medium III, i.e., the ink conveyed from ink channel 10 to first opening 10*a*, arranging at least a matching member having a middle value between specific acoustic impedances of medium I and III can effect reduction of the propagation loss. The matching member having the middle value may be formed considering a material and thickness thereof.

Figure 13:
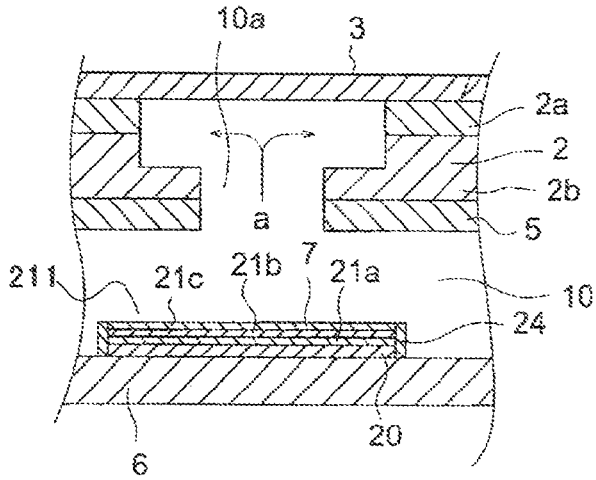
FIG. 13 is a cross-sectional view showing a portion in which an ultrasonic transducer is provided in the first embodiment.

FIG. 13 shows another embodiment of a matching member 211. A matching member 211 is formed of a layered matching member in which a plurality of matching members each having a different specific acoustic impedance are layered. A combination of an acrylic resin and a silicone resin can be applicable for matching member 211 by designing respective thickness of the resins. For example, assume that matching member 211 has first, second, and third matching members, 21*a*, 21*b*, and 21*c*, in which the first 21*a* is layered on piezoelectric vibrator 20, the second 21*b* is interposed between the first 21*a*. and the third 21*c*, and the third 21*c* is brought into contact with the ink, and specific acoustic impedances of the first 21*a*, the second 21*b*, the third 21*c*, piezoelectric vibrator 20, and the ink are Za, Zb, Zc, $Z_1$, and $Z_3$ in order. The first, second, third matching members 21*a*, 21*b*, and 21*c* are formed by the combination of the resins to satisfy a relationship $Z_1>Za>Zb>Zc>Z_a$. By reducing the specific acoustic impedance of matching member 211 step by step, propagation loss of the ultrasound can be further reduced, comparing with a matching member formed, of a single layer.

Figure 14:
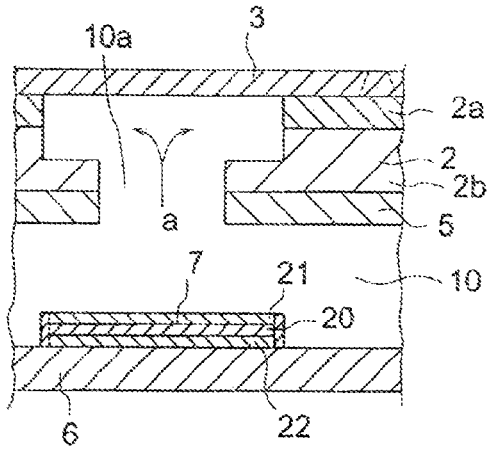
FIG. 14 is a cross-sectional view showing a portion in which the other ultrasonic transducer is provided in the first embodiment.

FIG. 14 shows the other embodiment of ultrasonic transducer 7. Ultrasonic transducer 7, when driven, radiates an ultrasound both toward the ink in ink channel 10 and toward housing 6 at the same time. Housing 6 causes the ultrasound to return toward piezoelectric vibrator 20 because the ultrasound reflects off an inside surface of housing 6. The ultrasound reflected may bring about interference with the ultrasound coming from ultrasonic vibrator 20. Then, if phases between the ultrasound reflected and the ultrasound directly coming from ultrasonic vibrator 20 are different from each other, the difference makes an ultrasonic oscillation in piezoelectric vibrator 20 unstable, resulting in energy loss of the ultrasound propagated toward first opening 10*a*.

To keep the ultrasonic oscillation stable, an ultrasonic absorbent 22 is interposed between piezoelectric vibrator 20 and an inside surface of housing 6, as shown in FIG. 14. Ultrasonic absorbent 22 can constrain the ultrasound propagated toward housing 6 from returning to piezoelectric vibrator 20, functioning to stabilize the ultrasonic oscillation. A material of ultrasonic absorbent 22 needs to have an ultrasonic absorption coefficient larger than that of a material of housing 6.

Figure 15:
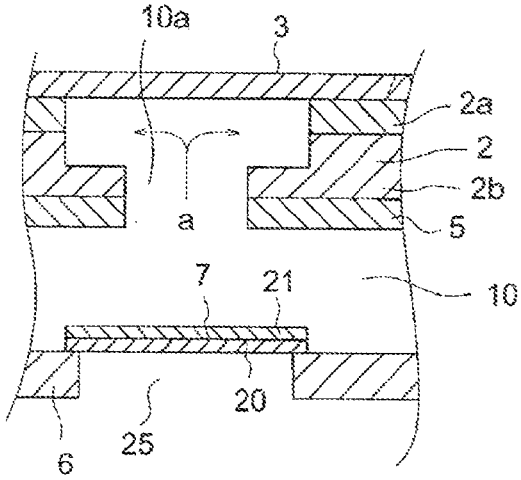
FIG. 15 is a cross-sectional view showing a portion in which the other ultrasonic transducer is provided in the first embodiment.

FIG. 15 shows the other modified embodiment of ultrasonic transducer 7. A third opening 25 is formed on housing 6 at a position where first opening 10*a* is faced with housing 6. Third opening 25 is covered with ultrasonic transducer 7 by gluing around third opening 25. One surface of piezoelectric vibrator 20 is exposed through third opening 25 to outside in a direction opposite to an ink flow direction that ink is conveyed to first opening 10*a*. Therefore, the ultrasound propagated in the opposite direction is radiated to air outside ink jet head 1. Since air does not reflect the ultrasound, the ultrasound out of ultrasonic vibrator 20 is propagated in the ink flow direction without a reflected ultrasound.

Second Embodiment

A second embodiment in the present invention will now be described.

Figure 16:
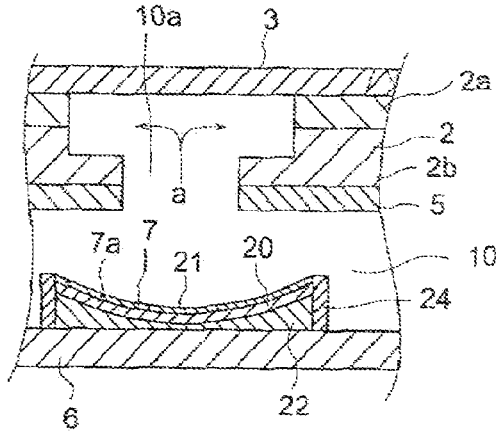
FIG. 16 is a cross-sectional view showing a portion in which an ultrasonic transducer is provided in the second embodiment.

With reference to FIG. 16, ultrasonic transducer 7 comprises a case 24, a laminated material 7*a* including piezoelectric vibrator 20 and matching member 21, and a ultrasonic absorbent 22 with which a space surrounded by case 24 and laminated material 7*a* is filled. Ultrasonic transducer 7 is affixed on an inside surface of housing 6 to propagate an ultrasound to ink in ink channel.

Laminated material 7*a* is formed in a concaved shape such that one surface thereof facing first opening 30 is concaved to converge the ultrasound therefrom in the ink flow direction. The shape of laminated material 7*a* forms an acoustic lens to converge the ultrasound. Since the ultrasound propagated from laminated material 7*a* is focused on in the vicinity of first, opening 10*a*, ink in channel 10 can be effectively conveyed toward first opening 10*a* with less power supplied to ultrasonic transducer 7.

Incidentally laminated material 7*a* may be directly affixed on a concave surface machined on an inside surface of housing 6, the concave surface corresponding to a shape of laminated material 7*a*.

Figure 17:
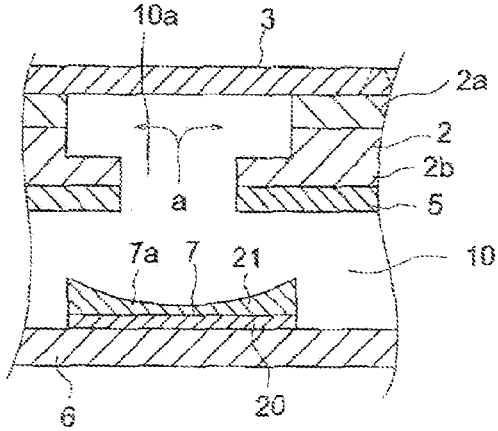
FIG. 17 is a cross-sectional view showing a portion in which the other ultrasonic transducer is provided in the second embodiment.

A modified example in the second embodiment will be described with reference to FIG. 17. Ultrasonic transducer 7 comprising a laminated material 7*a* including a flat piezoelectric vibrator 20 and matching member 21 is affixed in an inside surface of housing 6 at a position that first opening 10*a* is faced with laminated material 7a. A surface of matching member 21 contacting with ink is made concave to converge an ultrasound propagated from laminated material 7*a* so that the ultrasound is focused on in the vicinity of first opening 10*a*. Matching member forms, so called, an acoustic lens. Matching member 21 is, for example, made of an acrylic resin, and glued on a surface of piezoelectric vibrator 20. Since the ultrasound propagated from laminated material 7*a* including the acoustic lens is focused on in the vicinity of first opening 10*a*, the ink in channel 10 can be effectively conveyed toward first opening 10*a* with less power supplied to ultrasonic transducer 7.

Figure 18:
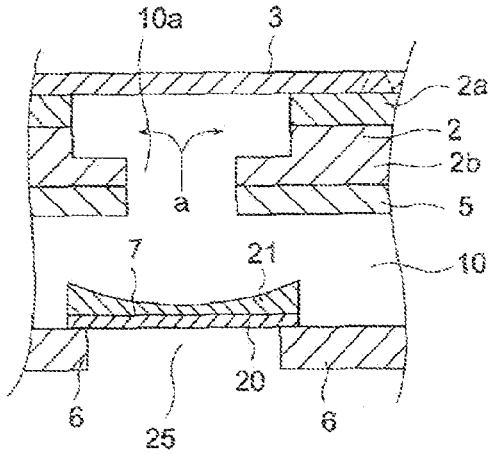
FIG. 18 is a cross-sectional view showing a portion in which the other ultrasonic transducer is provided in the second embodiment.

Another modified example in the second embodiment will be described, with reference to FIG. 18. Description in terms of like portions shown in FIG. 17 is omitted and only a different portion will be described. A third opening 25 is formed on housing 6 at a position where first opening 10*a* is faced with housing 6. Third opening 25 is covered with ultrasonic transducer 7 by gluing around third opening 25. One surface of piezoelectric vibrator 20 is exposed through third opening 25 to outside in a direction opposite to an ink flow direction that ink is conveyed to first opening 10*a*. Therefore, the ultrasound propagated in the opposite direction is radiated to air outside ink jet head 1. Since air does not reflect the ultrasound, ultrasound out of ultrasonic vibrator 20 is propagated in the ink flow direction without a reflected ultrasound.

Figure 19:
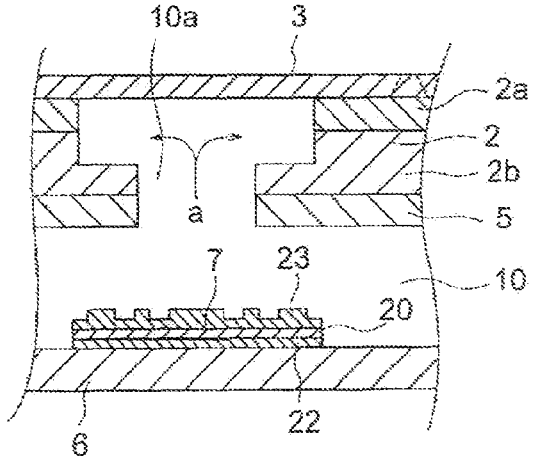
FIG. 19 is a cross-sectional view showing a portion in which the other ultrasonic transducer is provided in the second embodiment.
Figure 20:
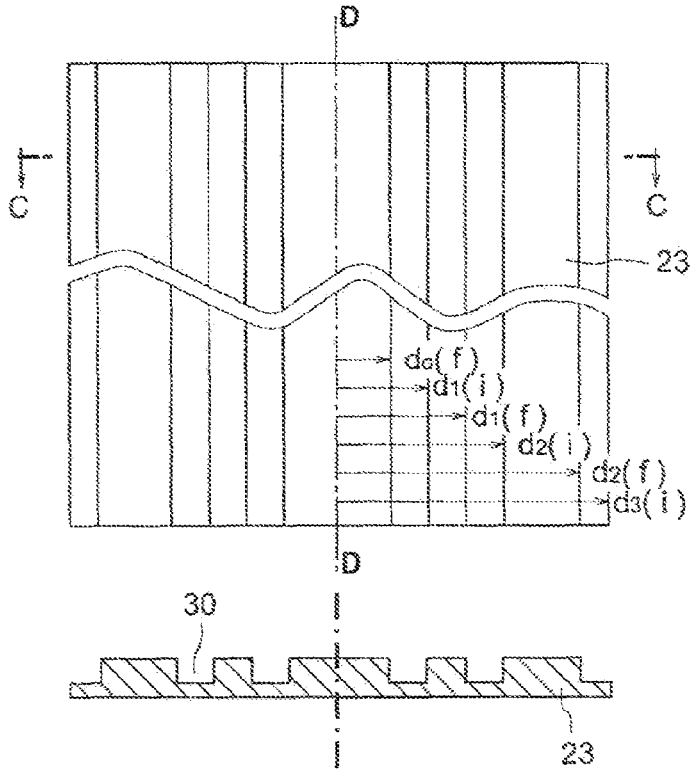
FIG. 20 is a plan view of a Fresnel lens with a cross-sectional view taken along with C-C line in the second embodiment.

Another modified example in the second embodiment will be described with reference to FIG. 19. An ultrasonic transducer 7 comprises a flat piezoelectric vibrator 20 and Fresnel lens 23 which is layered on a surface of piezoelectric vibrator 20 and is exposed to ink in ink channel 10 to act as an acoustic lens. FIG. 20 shows a plan view of Fresnel lens 23 and a cross sectional view taken along with C-C line. Fresnel lens 23 is formed to include a plurality of grooves each having a prescribed width and depth and being arranged at a prescribed distance from a center line D-D so that ultrasound propagated from piezoelectric vibrator 20 is focused on in the vicinity of first opening 10*a*. A preferred material of Fresnel lens 23 includes an acrylic resin, because a specific acoustic impedance of the acrylic resin has a middle value between specific acoustic impedances of piezoelectric vibrator, i.e., piezoelectric ceramic, and ink. Although the acrylic resin for the material of Fresnel lens is exemplified, the material is not restricted. A material having a specific acoustic, impedance less than piezoelectric vibrator 20 and larger than ink may also be available. Dimension of groove of Fresnel lens can be calculated with reference to formulas (3) and (4) shown in FIG. 21.

Fresnel lens in this example is formed of acrylic resin plate having a rectangle shaped by a machine process. The plate measures 20 mm in width and 1.12 mm in thickness. A plurality of grooves 30 are formed on the plate in accordance with dimensions listed in FIG. 21. Depth of the groove 30 is 0.84 mm. As set forth above, the processed Fresnel lens can serve as a matching member by adjusting depth of groove and entire thickness of the lens and selecting a material of an acoustic lens to meet a desired specific acoustic impedance. In other words, forming a remaining thickness of the Fresnel lens with $\lambda/4$, the thickness being obtained by subtracting a depth of the groove from entire thickness of the lens, makes the lens function as a matching layer. Therefore, since the ultrasound radiated from a piezoelectric vibrator is focused on in the vicinity of first opening 10*a*, the ink in ink channel 10 can effectively conveyed to first opening 10*a*.

Figure 22:
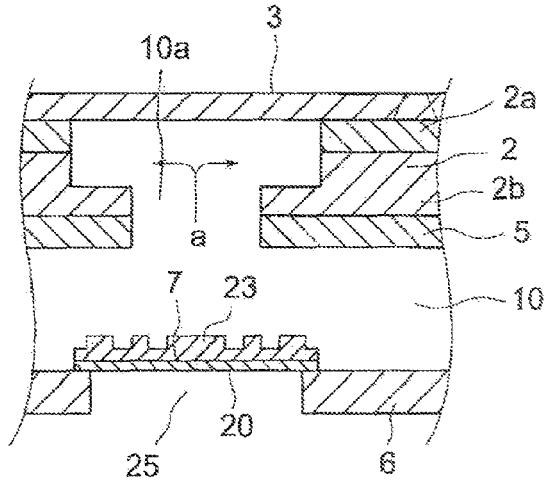
FIG. 22 is a cross-sectional view showing a portion in which the other ultrasonic transducer is provided in the second embodiment.

FIG. 22 shows a modified example of ink jet head 1 employing Fresnel lens 23. The example has like main portion shown in FIG. 19. Differing from, that, housing 6 of ink jet head 1 includes third opening 25. Similarly to the example shown in FIG. 18, one surface of piezoelectric vibrator 20 is exposed through third opening 25 to outside in a direction opposite to an ink flow direction that ink is conveyed to first opening 10*a*. Therefore, the ultrasound propagated in the opposite direction is radiated to air outside ink jet head 1. Since air does not reflect the ultrasound, ultrasound out of ultrasonic vibrator 20 is propagated in the ink flow direction without a reflected ultrasound.

Third Embodiment

Figure 23:
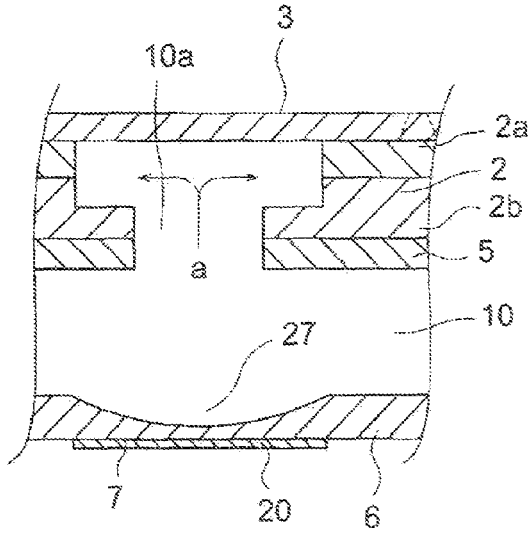
FIG. 23 is a cross-sectional view showing a portion in which an ultrasonic transducer is provided in the third embodiment.

A third embodiment will now be described with reference to FIG. 23. Piezoelectric vibrator 20 is affixed on an outside surface of housing 6 at a position that an ultrasound propagated from piezoelectric vibrator 20 is directed to first opening 10*a*. A concave surface 27 is formed on an inside surface of housing 6 at the position. In other words, piezoelectric vibrator 20 and a part of housing 6 are integrated into ultrasonic transducer 7. A concave acoustic lens is formed of both the outside surface provided with piezoelectric vibrator 20 and the inside surface opposite the outside surface to converge the ultrasound in the vicinity of first opening 10*a*. It is preferred to select a material of housing 6 having a specific acoustic impedance less than that of piezoelectric vibrator 20 and larger than that of the ink, since housing 6 further serves as a matching member.

Incidentally, although housing 6 in which an inside surface includes a concave surface is exemplified, other housing having flat inside and outside surfaces may be available. Since the flat inside surface of the housing does not converge an ultrasound, ink circulation speed becomes slower than that in housing 6 having the concave inside surface. However, the housing including the fiat inside surface may be applicable for an ink jet head that does not require as high speed as circulation.

In case that piezoelectric vibrator 20 is provided on an outside of housing 6, since piezoelectric vibrator 20 is not brought into direct contact with the ink, a surface of piezoelectric vibrator 20 is not corroded. Therefore, a passivation layer is not needed to protect the surface of piezoelectric vibrator 20.

The present invention may not be restricted to an ink jet head having a piezoelectric actuator to eject an ink droplet by deformation thereof. The present invention can also be applied to the other ink jet head capable of circulating ink through an ink pressure chamber in a similar way of the above embodiments.

Furthermore, in place of piezoelectric vibrator 20 generating an ultrasound, an electrostriction device or a magnetostriction device may be available.

The present invention has been described with respect to specific embodiments. However, other embodiments based on the principles of the present invention should be obvious to those of ordinary skill in the art. Such embodiments are intended to be covered by the claims.

What is claimed is:

1. An ink jet head for ejecting ink to record an image on a recording medium, comprising:

a pressure chamber partitioned by a side wall shared with adjacent pressure chambers and formed of a piezoelectric material with an electrode on a surface thereof, the pressure chamber having both ends through which ink flows into the pressure chamber;

a nozzle configured to eject ink from the pressure chamber therethrough;

a first common ink chamber provided at one of the ends of the pressure chamber to supply ink to the pressure chamber;

a second common ink chamber provided at the other end of the pressure chamber to take ink from the pressure chamber;

an ink channel configured to flow ink from the first common ink chamber to the second common ink chamber; and an ultrasonic transducer for generating an ultrasound to forcibly move ink by a pressure of the ultrasound, the transducer being arranged in the ink channel, wherein ink is forcibly circulated by the ultrasonic pressure through the first common ink chamber, the pressure chamber, the second common ink chamber, and the ink channel.

2. The ink jet head according to claim 1, wherein the ink channel is arranged to interpose the pressure chamber between the nozzle and the ink channel.

3. The ink jet head, according to claim 2, wherein the first common ink chamber includes an opening and the ultrasonic transducer is disposed such that the ultrasonic pressure from the transducer is directed to the opening on the first common ink chamber.

4. The ink jet head according to claim 3, wherein the ink channel is formed by a housing and the ultrasonic transducer is disposed on a surface of the housing exposed to the ink channel.

5. The ink jet head according to claim 1, wherein the ink channel is formed by a housing and the ultrasonic transducer is formed of a laminated material including a piezoelectric vibrator disposed on an inside surface of the housing and a matching member covered on the piezoelectric vibrator, and wherein a specific acoustic impedance of the matching member is set to less than that of the piezoelectric vibrator and greater than that of the ink.

6. The ink jet head according to claim 1, wherein the ultrasonic transducer includes an acoustic lens through which the ultrasound converges in a direction toward the first common ink chamber.

7. The ink jet head according to claim 1, wherein the ink channel is formed by a housing and the ultrasonic transducer is disposed on an outside surface of the housing.

8. The ink jet head, according to claim 7, further including an acoustic lens formed on an inside surface of the housing at a position opposite to the ultrasonic transducer so that the ultrasound from the transducer converges in a direction toward, the first common ink chamber.

9. The ink jet head according to claim 1, wherein the ink is ejected from the nozzle in a direction orthogonal to an ink flowing direction in the pressure chamber.

10. An ink jet head for ejecting ink to record an image on a recording medium, comprising:

two parallel pressure chamber lines each including a plurality of pressure chambers in which ink flows in a direction orthogonal to the pressure chamber line, each of the pressure chambers being partitioned by a side wall shared with adjacent pressure chambers and formed of a piezoelectric material with an electrode on a surface of the side wall;

a plurality of nozzles configured to eject ink from the respective pressure chambers therethrough;

a first common ink chamber provided between the two pressure chamber fines to supply ink into the respective pressure chambers of two pressure chamber lines, respectively;

second common ink chambers respectively provided at an opposite side of the first common ink chamber with respect to the respective pressure chamber lines to take ink from pressure chambers of respective pressure chamber lines into the corresponding second common ink chambers;

an ink channel configured to flow ink from the first common ink chamber to the respective second common ink chambers; and an ultrasonic transducer for generating an ultrasound to forcibly move ink by a pressure of the ultrasound, the transducer being arranged in the ink channel, wherein ink is forcibly circulated by the ultrasonic pressure through the first, common ink chamber, the pressure chambers of respective pressure chamber lines, the respective second common ink chambers, and the ink channel.

11. The ink jet head according to claim 10, wherein the ink channel is arranged to interpose the pressure chamber between the nozzle and the ink channel.

12. The ink jet head according to claim 11, wherein the ink channel is formed by a housing and the ultrasonic transducer is disposed on a surface of the housing exposed to the ink channel.

13. The ink jet head according to claim 10, wherein the ink channel is formed by a housing and the ultrasonic transducer is formed of a laminated material including a piezoelectric vibrator disposed on an inside surface of the housing and a matching member covered on the piezoelectric vibrator, and wherein a specific acoustic impedance of the matching member is set to less than that of the piezoelectric material and greater than that of the ink.

14. The ink jet head according to claim 10, wherein the ultrasonic transducer includes an acoustic lens through which the ultrasound converges in a direction toward the first common ink chamber.

15. The ink jet head according to claim 10, wherein the ink channel is formed by a housing and the ultrasonic transducer is disposed on an outside surface of the housing.

16. The ink jet head according to claim 15, further including an acoustic lens formed on an inside surface of the housing at a position opposite to the ultrasonic transducer so that the ultrasound converges in a direction toward the first common ink chamber.

17. The ink jet head according to claim 10, wherein the ink is ejected from the nozzle in a direction orthogonal to an ink flowing direction in the pressure chamber.

* * * * *